US006000062A

United States Patent [19]

Trakh

[11] Patent Number: 6,000,062

[45] Date of Patent: Dec. 14, 1999

[54] PROTECTIVE HEADBAND FOR SOCCER PLAYERS

[76] Inventor: Maz Trakh, 28118 El Montenero, Laguna Nigel, Calif. 92677

[21] Appl. No.: 08/949,509

[22] Filed: Oct. 14, 1997

[51] Int. Cl.[6] ..... A41D 20/00

[52] U.S. Cl. ..... 2/171; 2/200.1; 2/411; 2/425; 2/DIG. 11

[58] Field of Search ..... 2/171, 200.1, 411, 2/425, DIG. 11, 181, 183, 209.3

[56] References Cited

U.S. PATENT DOCUMENTS

| | | | |
|---|---|---|---|
| 4,394,782 | 7/1983 | Wasson | 2/181 |
| 4,698,852 | 10/1987 | Romero | 2/171 |
| 5,377,360 | 1/1995 | Fleitman | 2/171 |

*Primary Examiner*—Diana L. Biefeld
*Attorney, Agent, or Firm*—Robert M Sperry

[57] ABSTRACT

Improved head protection for soccer players comprising a headband formed of resilient material which may be worn alone or inside a conventional soccer helmet to cushion the effects of impacts to the head, especially for children in their formative years.

17 Claims, 1 Drawing Sheet

PROTECTIVE HEADBAND FOR SOCCER PLAYERS

FIELD OF INVENTION

This invention relates to soccer equipment and is especially directed to improved protective headbands for soccer players.

PRIOR ART

As is well known, soccer is probably the most popular game in the world and, in recent years has become increasingly popular in the United States, as well. Consequently, millions of children about the world learn to play soccer at early ages and spend a considerable portion of their childhood playing this game. Furthermore, soccer teams for children have become increasingly popular, enabling still more children to engage in this sport. Moreover, soccer is popular with both boys and girls. Unfortunately, soccer is a very vigorous sport which involves much body contact, which often leads to injury and occasionally death for the players. Furthermore, players often butt the ball or other players with their heads and it has been found that, especially with children in their formative years, such repeated butting can, and often does, lead to brain damage, which may be permanent. In order to prevent such head and brain injuries, helmets have been proposed. However, these helmets are usually formed of hard, rigid material and frequently cause scratching of the foreheads or sides of the players' heads. Furthermore, due to the rigidity of construction, these helmets often transmit much of the force of impact to the player's head and, hence, defeat the primary purpose of the helmet. Headbands have often been provided for soccer players. However, the prior art headbands have been formed of absorbent material and have been intended to absorb sweat. Unfortunately, these sweatbands do not provide adequate cushioning to protect the players against damage due to repeated head impacts. Thus, none of the prior art soccer head protecting devices have been entirely satisfactory.

BRIEF SUMMARY AND OBJECTS OF INVENTION

These disadvantages of the prior art are overcome with the present invention and improved head protecting devices are provided which are simple and inexpensive to produce and purchase and are simple to use, yet which provide a unique degree of protection for the players heads, especially for players in their formative years.

These advantages of the present invention are preferably attained by providing a headband formed of resilient material which may be worn alone or inside a conventional soccer helmet to cushion the effects of impacts to the head, especially for children in their formative years.

Accordingly, it is an object of the present invention to provide improved head protection for athletes.

Another object of the present invention is to provide improved head protection for soccer players.

An additional object of the present invention is to provide improved head protection for soccer players, especially children in their formative years.

A further object of the present invention is to provide improved head protection for soccer players which is simple and inexpensive to produce and purchase.

Another object of the present invention is to provide improved head protection for soccer players which is simple to use, yet which provide a unique degree of protection for the players' heads, especially for players in their formative years.

A specific object of the present invention is to provide improved head protection for soccer players comprising a headband formed of resilient material which may be worn alone or inside a conventional soccer helmet to cushion the effects of impacts to the head, especially for children in their formative years.

These and other objects and features of the present invention will be apparent from the following detailed description, taken with reference to the figures of the accompanying drawing.

DETAILED DESCRIPTION OF THE INVENTION

Figure 1:
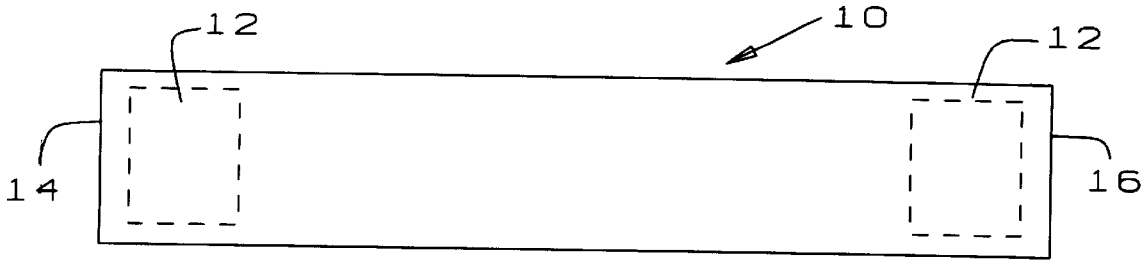
FIG. 1 is a rear view of a headband embodying the present invention.
Figure 2:
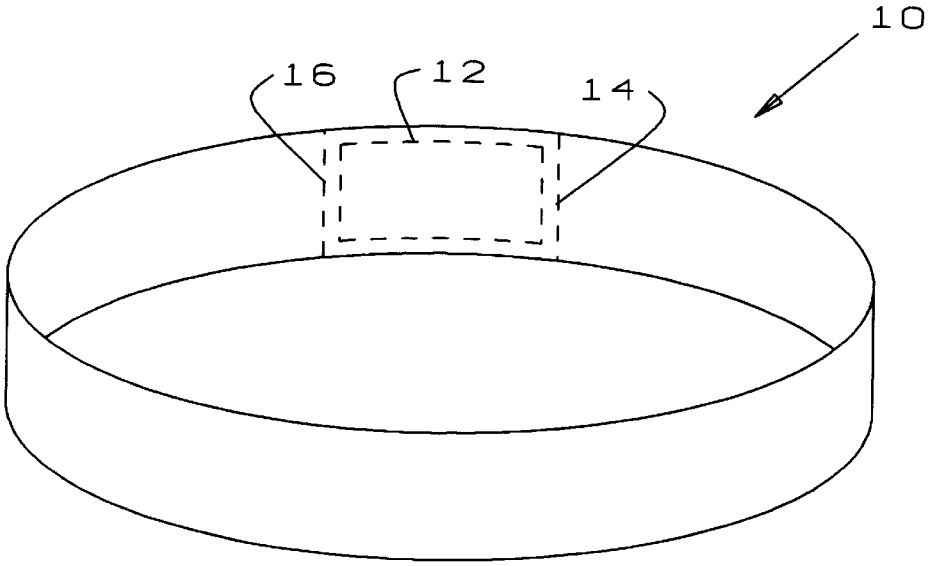
FIG. 2 is an isometric view showing the headband of the present invention attached for wearing.

In that form of the present invention chosen for purposes of illustration in the drawing, FIG. 1 shows a headband, indicated generally at 10, formed of resilient material, such as V-loop UBC, comprising 15% "Spandex" and 85% nylon, impregnated with neoprene or 100% nylon terry cloth impregnated with neoprene. The headband 10 preferably has a thickness of about 3 millimeters, but may be in the range of 2–5 millimeters Preferably, the lateral dimensions of the headband 10, are such that the headband 10 will cover the entire player's entire forehead and the area above the players ears on the sides of the player's head. As shown, the headband 10 has releasable fastening means 12, such as patches of hook-and-loop material, located adjacent the opposite ends 14 and 16 of the headband 10 and positioned to engage each other to releasably attach the ends 14 and 16 together to form a continuous loop, as seen in FIG. 2, to secure the headband 10 about a player's head. Alternatively, if desired, the ends 14 and 16 may be sewn together to form the headband 10, however, this provides less adjustability than having the releasable fastening means 12.

In use, the headband 10 is fastened about the player's head and may be worn alone or under a helmet. When worn with a helmet, the headband 10 serves to prevent the helmet from cutting or scratching the player's forehead. In any event, the headband 10 provides a cushioning agent which serves to reduce the impact when the player butts the soccer ball and significantly lessens the likelihood of brain injury to the player from repeated butting.

Figure 3:
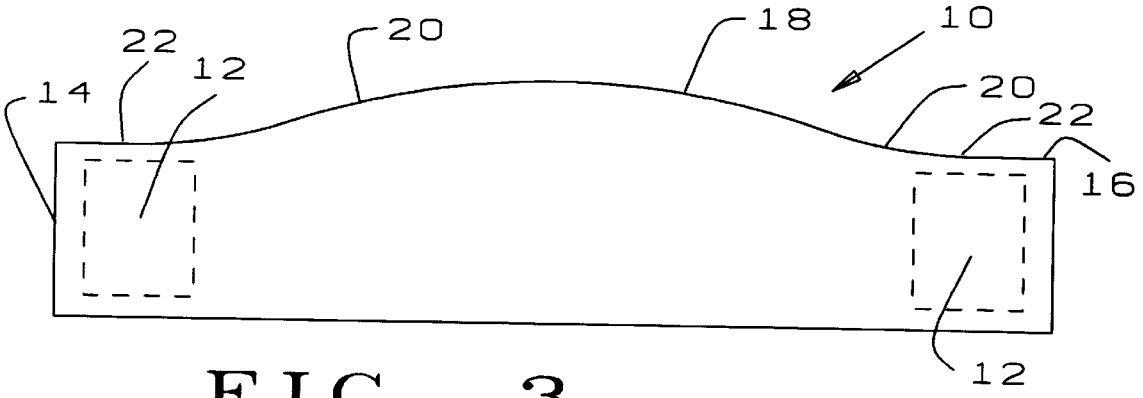
FIG. 3 is a rear view of an alternative form of the headband of FIG. 2.

FIG. 3 shows an alternative form of the headband 10 having an enlarged frontal area 18, designed to cover the player's entire forehead, but tapering downward along the sides 20 to provide merely an attaching strap 22 adjacent the ends 14 and 16. This form of the headband of the present invention functions in substantially the same manner as that of FIG. 1. Thus, the frontal portion 18 provides full protection for the player's forehead; which is the most sensitive to injury, while tapering downward at the sides 20 so as to be somewhat cooler for the wearer.

Obviously, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A headband comprising:

a band of impact-cushioning material formed of 15% "Spandex" and 85% nylon, impregnated with neoprene and formed with ends, and means attaching the ends of said band for placement about a person's head.

2. The headband of claim 1 wherein:

said ends are releasably attached.

3. The headband of claim 2 wherein:

said ends carry releasable fastening means.

4. The headband of claim 3 wherein:

said releasable fastening means are patches of hook-and-loop material.

5. The headband of claim 1 wherein:

said headband has a thickness in the range of 1–15 millimeters.

6. The headband of claim 1 wherein:

said headband has a thickness of 3 millimeters.

7. The headband of claim 1 wherein:

said headband has a lateral dimension sufficient to cover a person's entire forehead.

8. The headband of claim 1 wherein:

said headband has a frontal area having a lateral dimension sufficient to cover a person's entire forehead and having side portions tapering downward to provide merely an attaching strap adjacent the ends of said headband.

9. The headband of claim 1 wherein:

said band is a single layer of material.

10. A headband comprising:

a band of impact-cushioning material composed of 100% nylon terry cloth impregnated with neoprene and formed with ends, and means attaching the ends of said band for placement about a person's head.

11. The headband of claim 10 wherein:

said ends are releasably attached.

12. The headband of claim 11 wherein:

said ends carry releasable fastening means.

13. The headband of claim 12 wherein:

said releasable fastening means are patches of hook-and-loop material.

14. The headband of claim 10 wherein:

said headband has a thickness in the range of 1–15 millimeters.

15. The headband of claim 10 wherein:

said headband has a lateral dimension sufficient to cover a person's entire forehead.

16. The headband of claim 10 wherein:

said headband has a frontal area having a lateral dimension sufficient to cover a person's entire forehead and having side portions tapering downward to provide merely an attaching strap adjacent the ends of said headband.

17. The headband of claim 10 wherein:

said headband is a single layer of material.

* * * * *